US008806836B2

(12) United States Patent
James et al.

(10) Patent No.: US 8,806,836 B2
(45) Date of Patent: Aug. 19, 2014

(54) BUILDING ANCHOR SYSTEMS

(75) Inventors: Peter James, Gwent (GB); Dennis Lee, Newport (GB); Sara Paganoni, Bristol (GB); Dina D'Ayala, Bath (GB)

(73) Assignee: Cintec International Limited, Newport (GB)

( * ) Notice: Subject to any disclaimer, the term of this patent is extended or adjusted under 35 U.S.C. 154(b) by 244 days.

(21) Appl. No.: 13/395,684

(22) PCT Filed: Sep. 10, 2010

(86) PCT No.: PCT/GB2010/001708

§ 371 (c)(1),
(2), (4) Date: May 22, 2012

(87) PCT Pub. No.: WO2011/030105

PCT Pub. Date: Mar. 17, 2011

(65) Prior Publication Data

US 2012/0227351 A1 Sep. 13, 2012

(30) Foreign Application Priority Data

Sep. 14, 2009 (GB) ..... 0916073.0

(51) Int. Cl.

| | |
|---|---|
| ***E04B 1/38*** | (2006.01) |
| ***E04C 5/00*** | (2006.01) |
| ***E04G 23/02*** | (2006.01) |
| ***E04B 1/41*** | (2006.01) |

(52) U.S. Cl.

CPC ..... *E04B 1/4157* (2013.01); *E04G 23/0218* (2013.01); *E04G 23/0222* (2013.01)

USPC ..... 52/698; 52/231; 52/709; 52/710; 52/713; 52/285.1; 52/253; 52/656.9; 52/655.1; 403/408.1; 403/364; 411/84; 411/101

(58) Field of Classification Search

USPC ..... 52/698, 712, 223.12, 223.13, 713, 711, 52/714, 704, 223.9, 709, 285.1, 656.9, 52/655.1, 253, 298; 411/90, 93, 92, 94, 411/110, 84, 101; 403/364, 360, 362, 361

See application file for complete search history.

(56) References Cited

U.S. PATENT DOCUMENTS 6,065,263 A * 5/2000 Taguchi ..... 52/583.1
6,327,829 B1 * 12/2001 Taguchi ..... 52/583.1

(Continued)

FOREIGN PATENT DOCUMENTS

EP 1152102 A2 11/2001
FR 2558190 A1 7/1985

*Primary Examiner* — Chi Q Nguyen

(74) *Attorney, Agent, or Firm* — King & Schickli, PLLC

(57) ABSTRACT

A building anchor system includes a pair of elongate anchor rods (1,2), an anchor rod coupling joint (3) for joining the anchor rods end-on-end, the anchor rod coupling joint comprising or including a sleeve (4, 5, 6 & 7) for connection to an end of one of the anchor rods (1) a slideable arm (8) receivable in the sleeve for connection to an end of the other anchor rod (2) a closed slot within the arm or sleeve for slideably receiving the free end of a stop member (13) by which movement of the anchor rods along their major axis is possible to the extent allowed by the length of the slot, and frictional adjustment means (6,7) acting between the arm and the sleeve by which they may be joined and by which the force required to move them with respect to each other can be selectively varied. The invention also extends of a method of preventing or inhibiting catastrophic structural failure of a building by installing one or more anchor systems of the type described.

4 Claims, 1 Drawing Sheet

(56) References Cited

U.S. PATENT DOCUMENTS 6,622,442 B2 * 9/2003 Kwon ..... 52/259

6,679,017 B2 * 1/2004 Woodruff et al. ..... 52/283

* cited by examiner

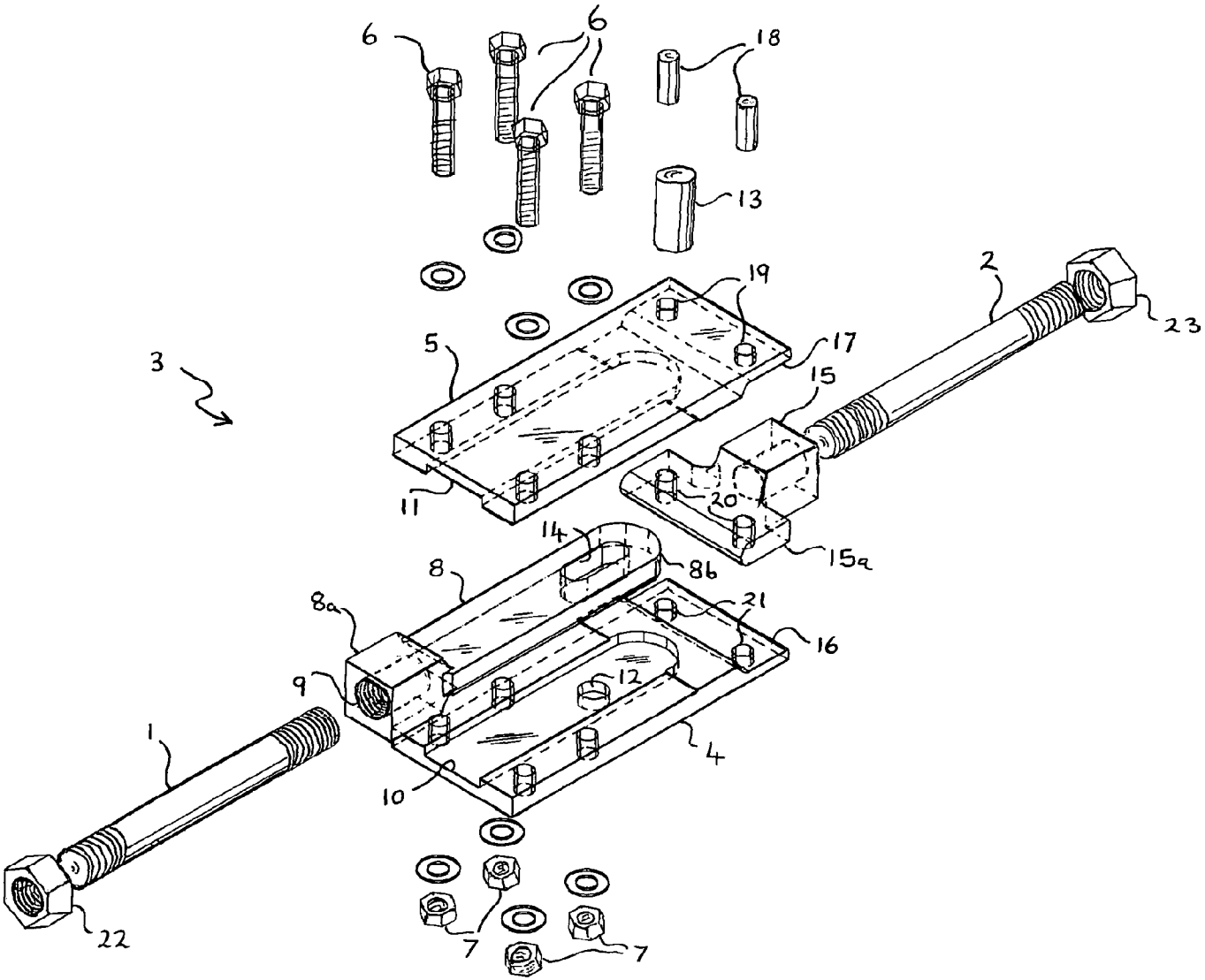
23
2
18
13
6
6
17
15
15a
19
20
5
11
16
21
4
8b
12
14
8
8a
9
10
7
7
3
1
22

BUILDING ANCHOR SYSTEMS

FIELD OF THE INVENTION

This invention relates to building anchor systems of the type that use anchor rods which are typically used to reinforce structural parts of buildings, such as walls, and in particular structural parts of old buildings which may otherwise be prone to damage from e.g. earthquakes or ground settlement.

BACKGROUND OF THE INVENTION

A building anchor typically comprises an elongate rod threaded at both ends so that it may be inserted within a hole formed along the length of a wall of a structure such as a building and onto which thrust plates may be then fitted and tightened by nuts to tension the anchor and thereby strengthen the wall against failure. Where the building is generally box-like two or more such anchors are secured between corners of the building along each wall, thereby considerably stiffening it and decreasing the likelihood of structural failure in the event of an earthquake or other such vibrational event. However, a problem with this known kind of reinforcement is that the anchor rods are so strong relative to the structures in which they are placed that during a severe earthquake or after a series of earth tremors it has been found that they remain in position even when the surrounding wall being reinforced has been caused to move by the tremors such that, typically on the leeward side of the epicenter of an earthquake, such walls are still prone to collapsing outwardly away from the anchors. In addition, the rigidity of the anchors along their major axis does not prevent torsional movement of a target structure within which they are placed, such that cracking of walls can occur diagonally which can also cause great damage even if the building remains upright afterwards.

SUMMARY OF THE INVENTION

In our Patent Application No. EP 01303883.1 (published as EP1152102) we describe a method of reinforcing a structure such as a wall or a bridge by drilling a hole along its length, inserting a metal reinforcement anchor enclosed within a permeable sock within the hole and filling the sock with cementitious grout whilst allowing part of the metal anchor to be exposed at selected parts along its length such that the anchor can move laterally in response to e.g. wall subsidence, without the anchor breaking. Whilst this method of reinforcement is an improvement over prior art anchoring systems which retain their rigidity and hence suffer the risk of breaking laterally, it is unsuitable for use in buildings requiring disguised reinforcement with minimal intrusion such as, in particular, in ancient buildings and monuments, where the preferred form of reinforcement is by drilling a relatively small diameter hole along e.g. the length of a wall to be reinforced by means of a steel anchor with thrust plates at each end which may be adjustable to increase or decrease the tension within the anchor to suit the circumstances.

The present invention is derived from the realization that there exists a need for a building anchor system which retains the advantages of imparting strength and rigidity to building structures, which therefore help to resist damage from relatively minor earthquakes, but which can also be non-elastically extendable during a major earthquake event so as to prevent or inhibit catastrophic structural failure of the surrounding building structure.

According to a first aspect of the invention there is provided a building anchor system comprising or including, a pair of elongate anchor rods, an anchor rod coupling joint for joining the anchor rods end-on-end, the anchor rod coupling joint comprising or including (a) a sleeve for connection to an end of one of the anchor rods (b) a slideable arm receivable in the sleeve for connection to an end of the other anchor rod (c) a closed slot within the arm or sleeve for slideably receiving the free end of a stop member by which movement of the anchor rods along their major axis is possible to the extent allowed by the length of the slot, and (d) frictional adjustment means acting between the arm and the sleeve by which they may be joined and by which the force required to move them with respect to each other can be selectively varied.

According to a second aspect of the invention there is provided an anchor rod coupling joint of the type described in the first aspect of the invention.

According to a third aspect of the invention there is provided a method of preventing or inhibiting catastrophic structural failure of a building by installing therewithin or thereabout one or more pairs of elongate anchor rods and associated coupling joint in accordance with the first aspect of the invention.

With this arrangement, building structures such as walls may be selectively anchored by varying amounts of frictional force depending upon the anticipated movement during e.g. a severe earthquake event so that above a selected level of tension being applied to the anchors they begin to separate at the anchor rod coupling joint up to the limit of travel permitted by the movement of the stop member in the slot, whereafter the anchor system then effectively becomes rigid once more even though the structure within which it is embedded may have moved and become lengthened along the major axis of the building anchors. As a result of this two-stage approach the anchor system is therefore able to absorb energy which would otherwise be concentrated solely at each end of the anchors, making it less likely that the building structure within which they are fitted will fail in the event of a major earthquake or similar event. In addition, because the anchor coupling joint itself is adjustable in terms of varying the amount of force required to move the pair of anchor rods apart, this lends itself to the concept of periodic checking and adjustment if necessary in response to e.g. minor subsidence so that the building anchor system is optimally maintained to provide the maximum rigidity required to keep the building structure within which it is fitted together, but adjusted to ensure that it is able to dissipate energy if necessary by allowing the anchor rods to move apart against the friction selectively dictated by the anchor rod coupling joint.

Conveniently, the anchor rod coupling joint is in the form of a base plate having a removable cover, each having inwardly facing channels which collectively define a sleeve into which the slideable arm may be received. The base plate may further include a recess, such as a bore, into which part of the stop member, such as a pin, may be inserted and the slideable arm may include a closed slot into which the remainder of the stop member can project, thereby permitting the arm to be pulled out of the sleeve under tension to the extent permitted by the length of the slot.

BRIEF DESCRIPTION OF THE DRAWING FIGURES

The invention will now be described, by way of example only, with reference to the accompanying drawing of an exploded view of a building anchor system for fitting within a wall structure (not shown).

DETAILED DESCRIPTION OF THE INVENTION

In the drawing, a pair of threaded anchor rods 1,2 are disposed along their common major axis on either side of an anchor rod coupling joint shown generally at 3 which comprises a rectangular base plate 4, a top or cover plate 5 which, when each are joined together by the bolts 6 and nuts 7, define a sleeve into which a slideable arm 8 may be inserted. The free end 8*a* of the slideable arm 8 includes a threaded bore 9 for receiving the threaded end of the anchor rod 1.

The arm 8 has a rounded end 8*b* and is shaped to fit within correspondingly shaped, but collectively shallower, inwardly facing channels 10, 11 in the base plate 4 and cover 5. The combined depth of the channels 10, 11 is less than the thickness of the slideable arm 8 so that when the cover 5 plate is fitted onto the base plate 4 and the bolts 6 and nuts 7 are tightened they each become an interference fit over the arm 8 and, depending upon the torque applied to the bolts and nuts 6, 7 the frictional force necessary to pull the arm 8 out of engagement with the base plate and cover 4, 5 can be varied in a manner to be described.

In the channel 10 of the base plate 4 is a closed bore 12 for receiving part of a stop member in the form of a frangible pin 13, the rest of which is received within a slot 14 formed in the end plate 8*b* of the slidable arm 8.

Anchor rod 2 is connectable to the base plate 4 and cover plate 5 by means of a generally "T"-shaped yoke 15 having a tongue portion 15*a* insertable within and between a pair of recessed steps 16, 17 in, respectively, the base plate 4 and cover plate 5. The assembly is held together by means of a pair of pins 18 which are inserted into and through respective pairs of bores 19, 20 and 21 extending through the cover plate 5, the tongue portion 15*a* of the yoke 15 and the stepped region 16 of the base plate 4. The pins 16 are a press fit and are collectively of the same overall diameter as the frangible pin 13 such that if the latter does not fail under a predetermined load the former will fail, to thereby ensure that further movement of the structure within which the anchor system is installed is possible.

In use, the anchor rods 1, 2, which for convenience are shown as relatively short but where, in practice, they would be long enough to collectively span the length of e.g., a wall to be reinforced, are inserted into bores within the target structure into which has also been formed a cavity for receiving the anchor rod coupling joint 3, being large enough to permit inspection of and adjustment to that part of the combined assembly, including the bolts 6 and nuts 7. The anchor rod coupling joint 3 is preferably preassembled with the bolts 6 and nuts 7 being tightened by a required amount by the use of e.g. a torque wrench, whereafter upon insertion within the cavity within the target structure the anchor rods 1, 2 are screwed into place and then tensioned by a required amount by tightening tensioning nuts 22, 23 at the free ends of respectively, the anchor rods 1, 2, usually using thrust plates (not shown) so as to achieve a desired level of tension between the anchor rods 1, 2.

In operation, during e.g. an earthquake event, the frictional clamping force acting between the base plate 4 and cover plate 5 is sufficient to resist any sliding movement of the arm 8, such that for minor earthquake events the anchor system remains stable. However, where tension in the anchor rods 1, 2 increases above a required level the arm 8 is able to move out of the sleeve defined by the base plate 4 and cover plate 5 within the attendant channels 10, 11 up to the limit defined by the length of the slot 14 in the slideable arm 8. At this point the anchor system then becomes rigid again and is therefore able to resist further movement until the tension in the anchor rods 1, 2 increases to a point sufficient to break the frangible pin 13 and/or the pair of pins 16, at which point the tension in the system is released entirely. It will therefore be understood that by adopting this two stage approach it is possible to dissipate much of the energy in the system during e.g. an earthquake event, to therefore lessen the likelihood of the target structure within which the anchor bolts 1, 2 have been placed suddenly experiencing catastrophic failure.

The invention claimed is:

1. A building anchor system comprising: a pair of elongate anchor rods (1, 2), an anchor rod coupling joint (3) for joining the anchor rods end-on-end, the anchor rod coupling joint comprising (a) a sleeve (4, 5, 6 & 7) for connection to an end of one of the anchor rods (1, (b) a slideable arm (8) receivable in the sleeve for connection to an end of the other anchor rod (2), (c) a closed slot (14) within the arm or sleeve for slideably receiving a free end of a stop member (13) by which movement of the anchor rods along a major axis of the anchor rods is possible to the extent allowed by a length of the slot, and (d) frictional adjustment means (6,7) acting between the arm and the sleeve by which the arm and the sleeve are joined and by which the force required to move the arm and the sleeve with respect to each other can be selectively varied, wherein the anchor rod coupling joint (3) is in the form of a base plate (4) having a removable cover (5), each having inwardly facing channels (10,11) which collectively define the sleeve into which the slideable arm (8) is received, said base plate (4) further includes a recess (12) into which part of the stop member (13) is inserted.

2. An anchor system according to claim 1, wherein the closed slot (14) is configured to allow the remainder of the stop member (13) to project, thereby permitting the arm to be pulled out of the sleeve under tension to the extent permitted by the length of the slot.

3. An anchor rod coupling joint comprising: (a) a sleeve (4, 5, 6 & 7) for connection to an end of anchor rods (1), (b) a slideable arm (8) receivable in the sleeve for connection to an end of another anchor rod (2), (c) a closed slot (14) within the arm or sleeve for slideably receiving a free end of a stop member (13) by which movement of the anchor rods along a major axis of the anchor rods is possible to the extent allowed by a length of the slot, and (d) frictional adjustment means (6,7) acting between the arm and the sleeve by which the arm and the sleeve are joined and by which the force required to move the arm and the sleeve with respect to each other can be selectively varied, wherein the coupling joint is in the form of a base plate (4) having a removable cover (5), each having inwardly facing channels (10,11) which collectively define the sleeve into which the slideable arm (8) is received, said base plate further includes a recess (12) into which part of the stop member (13) is inserted.

4. An anchor rod coupling joint according to claim 3, wherein the slideable arm (8) includes a closed slot (14) into which the remainder of the stop member (13) can project, thereby permitting the arm to be pulled out of the sleeve (4, 5, 6 & 7) under tension to the extent permitted by the length of the slot.

* * * * *